United States Patent [19]

Hesse

[11] Patent Number: 4,509,813

[45] Date of Patent: Apr. 9, 1985

[54] RETAINING CLIP FOR HOLDING A CONNECTOR TO A PANEL

[75] Inventor: David L. Hesse, Chicago, Ill.

[73] Assignee: Allied Corporation, Morristown, N.J.

[21] Appl. No.: 547,693

[22] Filed: Nov. 1, 1983

[51] Int. Cl.[3] ..... H01R 13/627

[52] U.S. Cl. ..... 339/91 R

[58] Field of Search ..... 339/91 R, 19, 17 C, 339/95 D

[56] References Cited

U.S. PATENT DOCUMENTS

| | | | |
|---|---|---|---|
| 3,706,954 | 12/1972 | Krafthefer | 339/17 L |
| 3,846,739 | 11/1974 | Muz | 339/221 R |
| 3,894,783 | 7/1975 | Messner | 339/91 R |
| 3,918,784 | 11/1975 | Lemke et al. | 339/17 C |
| 3,950,060 | 4/1976 | Stipanuk et al. | 339/91 R |
| 4,056,299 | 11/1977 | Paige | 339/95 D |
| 4,057,879 | 11/1977 | Eigenbrode | 339/91 R |
| 4,066,317 | 1/1978 | Bierenfeld et al. | 339/91 R |
| 4,070,081 | 1/1978 | Takahashi | 339/91 R |
| 4,079,343 | 3/1978 | Nijman | 339/147 R |
| 4,319,733 | 3/1982 | Hanna et al. | 339/91 R |

FOREIGN PATENT DOCUMENTS

| | | | |
|---|---|---|---|
| 1251400 | 10/1967 | Fed. Rep. of Germany | 339/95 D |
| 320120 | 2/1970 | Sweden | 339/95 D |
| 1536189 | 12/1978 | United Kingdom | 339/95 D |

*Primary Examiner*—John McQuade

*Attorney, Agent, or Firm*—C. D. Lacina

[57] ABSTRACT

A retaining clip (30) for releasably holding a connector (20) to a pin (18) extending from a circuit board (10), the connector (20) having an abutment shoulder (24) and the clip comprising a base member (32) having a plurality of locking lances (40) the edges of which engage one pin at only one point and a bracket (34) which has a reversely bent locking prong (36) to engage the abutment shoulder on the connector.

4 Claims, 6 Drawing Figures

FIG. 3
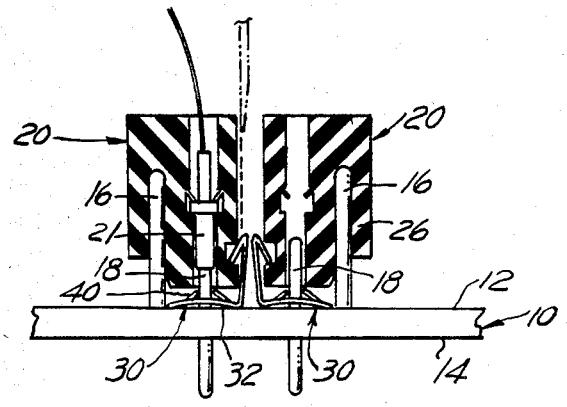
FIG. 4
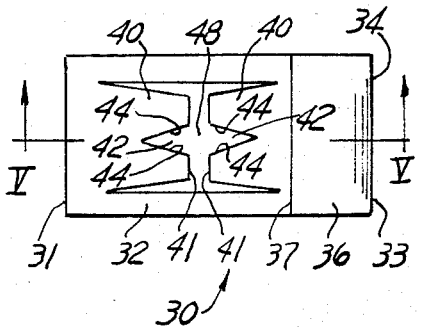
FIG. 5
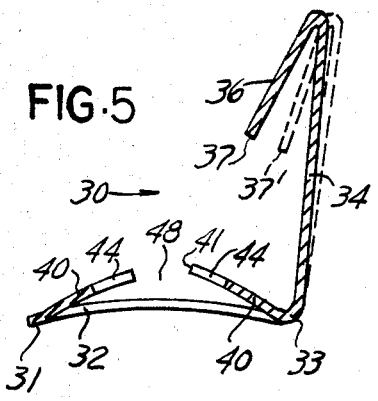
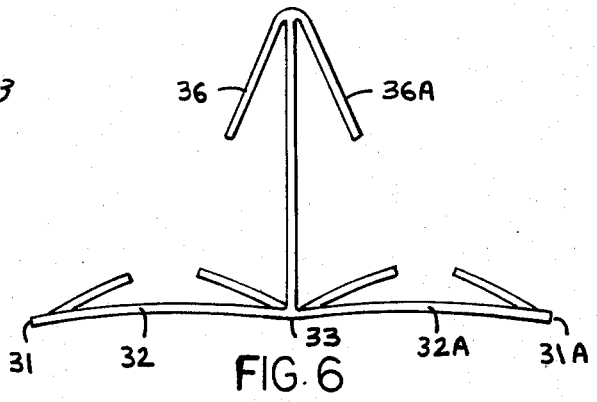
FIG. 6

RETAINING CLIP FOR HOLDING A CONNECTOR TO A PANEL

This invention relates to a retaining clip for releasably holding a socket electrical connector in engagement with a pin projecting upwardly from a circuit board.

To force fit one part into another by means of a clip having locking tabs attachable to one or both of the parts is known in electrical connector art. Some fastener clips include a configuration wherein a portion of the clip follows the general contour of the parts.

This invention relates to a force fitting projection for engaging a pin extending from a printed circuit board for interconnection to an electrical connector socket with a snap fit.

A particular advantage of the retaining clip is a four-corner retention of the pin that prevents damage to plating of the pin.

One way of carrying out the invention is described in detail below with reference to the drawings which illustrate the specific embodiment of this invention, in which:

FIG. 3 is a side view, partially in section, of a pair of electrical connnector sockets retained by retaining clips.

FIG. 4 is a plan view of the retaining clip.

FIG. 5 is an elongated view of the retaining clip, in section, taken along lines V—V of FIG. 4.

FIG. 6 is an alternate retaining clip.

Figure 1:
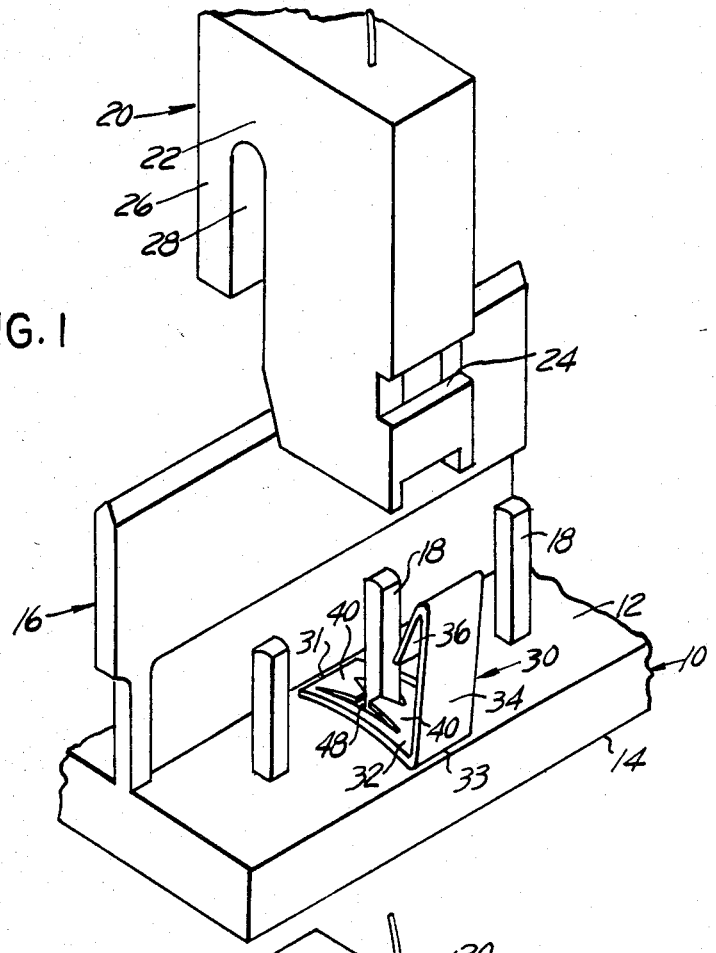
FIG. 1 is a perspective view of a printed circuit board having a retaining clip for releasably holding a connector socket thereto.

Referring now to the drawings, FIG. 1 shows a printed circuit board 10 having planar top and bottom faces 12, 14 and including a guide rail 16 extending perpendicularly from the top face 12, the board including a row of conductive pin contacts 18 extending through the board and having their outward extensions therefrom disposed perpendicular to the respective faces. A socket electrical connector 20 includes a dielectric housing 22 receiving a socket contact 21 (see FIG. 3) and a body portion 26 extending therefrom, the housing having an abutment shoulder 24 and the body portion 26 defining a channel 28 between the housing, the channel being adapted to seat about the guide rail for supporting and positioning the electrical connector and its socket contact relative to the row of pin contacts whereby the socket contact may be mated with one of the pins to complete an interconnection.

A retaining clip 30 for releasably holding electrical connector 20 and socket contact 21 in engagement with the pin 18 includes a base member 32 adapted to seat on the circuit board and a locking prong 36 adapted to have a deflectable end 37 thereof seat against abutment shoulder 24, the base member seating its opposite edges 31, 33 on the board, having its center portion bowed and spaced from the board, and including a plurality of lances 40 defining an opening 48 for receiving and engaging one of the pins. Two lances 40 of generally rectangular shape are stamped from base member 32 with each lance extending at an acute angle therefrom as a cantilever to its distal end 41, each of the distal ends confronting and each including a V-shaped notch 42 defined by opposing edges 44, the two notches frictionally engaging the pin. A bracket 34 extends upwardly from the base member and includes the reversely bent locking prong 36 having its distal end 37 for engaging the abutment shoulder.

Although in a preferred embodiment clip 30 is stamped and formed of a resilient metal, the clip could be molded of a suitable plastic.

Figure 2:
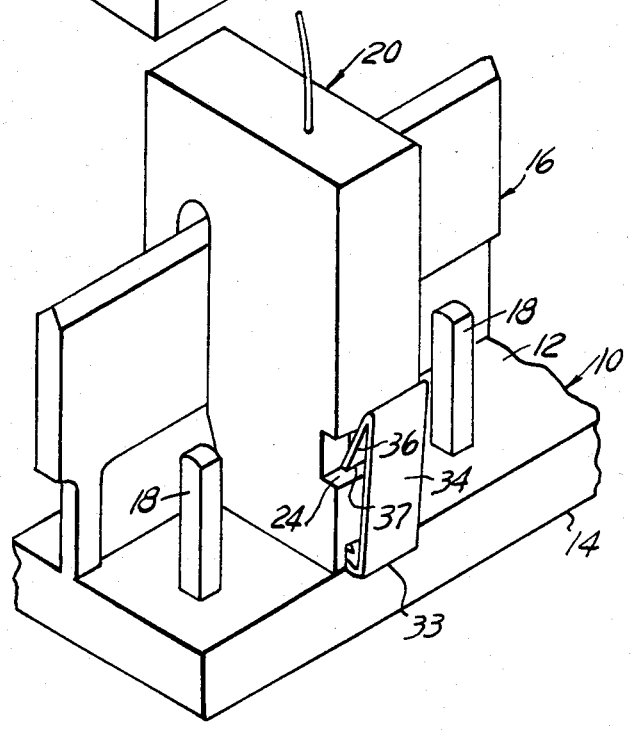
FIG. 2 shows the electrical connector socket releasably held by the retaining clip.

FIG. 2 shows socket electrical connector 20 mounted to guide rail 16 and locking prong 36 with end 37 seated on abutment shoulder 24 to releasably retain the connector 20 thereto.

FIG. 3 shows printed circuit board 10 including a pair of guide rails 16, two rows of contact pins 18 disposed therebetween, a retaining clip 30 received about one pin 18 on each row, and a connector housing 20 supported on each guide rail 16 with one housing having the socket contact 21 therein mated with the pin.

For release of connector 20, a blade (shown in phantom) would be inserted downwardly and against locking prong 36 whereby the prong is deflected laterally and off from the shoulder 24 whereby the connector 20 may be disconnected from the pin 18.

FIG. 4 shows detail of retaining clip 30, the lances 40 and the central pin receiving opening 48 defined by the V-notches 42, Each of the two V-notches 42 are facing one another with each extending inwardly from each lateral edge 41, the side walls 44 defining each notch being adapted to engage the pin.

FIG. 5 shows a side view, in section, of retaining clip 30. Bracket 34 is extending substantially perpendicularly upward from edge 33 of base member 30, the center of base member being bowed upwardly relative to opposite edges 31, 33 and lances 40 extending at an acute angle to center portion of the base member. Locking prong 36 extends downwardly from the bracket at an acute angle in the direction of the central opening 48. The phantom lines show a release configuration of bracket 34, locking prong 36 and distal end 37.

FIG. 6 shows an alternate embodiment for simultaneously locking spaced rows of connectors (such as shown in FIG. 3) with respective pins. The retaining clip includes a like pair of base members 32, 32A and the bracket 34 includes a pair of reversely bent locking prongs 36, 36A, each of the base members being interconnected along one like edge 33 and bracket 34 extending upwardly from the interconnection, the locking prongs 36, 36A being reversely bent and directed downardly towards its respective base member 32, 32A.

It is to be understood that the retaining clips of FIGS. 1–5 or of FIG. 6 could be elongated to releasably secure a plurality of connectors to a row of laterally separated pins. A plurality of separate like pin engaging openings 48 would be disposed in a line to receive respective of the pins. Also, in such case, a plurality of brackets 34 could extend from base member 32 with each such bracket being capable of deflecting independently of the other brackets to permit only one connector to be released.

I claim:

1. A retaining clip for releasably holding a socket electrical connector in engagement with a pin projecting from a circuit board, the socket electrical connector including a dielectric housing having an abutment shoulder and an aperture for fitting about the pin, said retaining clip being characterized by: a base adapted to seat on the circuit board and comprising a like pair of base members interconnected along one like lateral edge, means operative with each said base member for engaging one said pin, and means including a bracket extending upwardly from said interconnection for engaging one said abutment shoulder, each said base member including a pair of upwardly extending plate portions with each said plate portion having a V-shaped notch disposed therein to define a plurality of lances, said pin engaging means being defined by each respective pair of plate portions and associated notches cooperating to define an opening for receiving the respective pin with each said notch having an edge to frictionally engage an edge of the pin, and said bracket includes a pair of locking prongs each being directed downwardly from said bracket toward one respective base member.

2. The invention as recited in claim 1 wherein each said base member includes a lateral center portion and including means for spacing the center portion of each said base member vertically upward from said circuit board.

3. The invention as recited in claim 2 wherein said spacing means comprises said each base member being bowed concavely relative to the plane of the circuit board whereby when said base is seated on said circuit board the center portion of each said base member is spaced vertically upward from the circuit board.

4. The invention as recited in claim 1 wherein the retaining clip is integral.

* * * * *